US007685849B2

(12) United States Patent
Worthington

(10) Patent No.: US 7,685,849 B2
(45) Date of Patent: Mar. 30, 2010

(54) METHODS AND APPARATUS FOR MONITORING A WASHING MACHINE

(75) Inventor: Tim D. Worthington, Crestwood, KY (US)

(73) Assignee: General Electric Company, Schenectady, NY (US)

( * ) Notice: Subject to any disclaimer, the term of this patent is extended or adjusted under 35 U.S.C. 154(b) by 654 days.

(21) Appl. No.: 11/287,618

(22) Filed: Nov. 28, 2005

(65) Prior Publication Data

US 2007/0119217 A1 May 31, 2007

(51) Int. Cl.
*D06F 33/02* (2006.01)
*D06F 35/00* (2006.01)
*D06F 39/00* (2006.01)

(52) U.S. Cl. ..... 68/12.04; 68/12.05; 68/12.19; 68/12.23

(58) Field of Classification Search ..... 8/158, 8/159; 68/12.02, 12.04, 12.05, 12.19, 12.23
See application file for complete search history.

(56) References Cited

U.S. PATENT DOCUMENTS

| | | | | |
|---|---|---|---|---|
| 6,634,191 | B1 | 10/2003 | Guler et al. | |
| 6,842,929 | B2 * | 1/2005 | Kim et al. | 8/159 |
| 6,880,574 | B1 * | 4/2005 | Porto | 137/624.11 |
| 2004/0188467 | A1 * | 9/2004 | Miefalk et al. | 222/156 |
| 2005/0226192 | A1 * | 10/2005 | Red et al. | 370/338 |

* cited by examiner

*Primary Examiner*—Joseph L Perrin
(74) *Attorney, Agent, or Firm*—George L. Rideout, Esq.; Armstrong Teasdale LLP

(57) ABSTRACT

A control system for a home appliance includes a cabinet, a wash tub positioned within the cabinet and configured to receive laundry therein, and a fill device configured to deliver liquid into the tub. The control system includes a first detecting component configured to detect an amount of the liquid delivered into the wash tub, a second detecting component configured to detect a liquid level in the wash tub, and a controller operatively coupled with the detecting components. The controller is configured to receive signals from the detecting components and calculate an amount of the laundry positioned within the wash tub based on the received signals.

22 Claims, 4 Drawing Sheets

170

METHODS AND APPARATUS FOR MONITORING A WASHING MACHINE

BACKGROUND OF THE INVENTION

This invention relates generally to washing machines, and, more particularly, to methods and apparatus for detecting laundry amount in washing machines.

Clothes treatment machines, such as for example, washing machines typically include a cabinet that houses an outer tub for containing wash and rinse water, a perforated laundry basket within the tub, and an agitator within the basket. A drive and motor assembly is mounted underneath the stationary outer tub to rotate the laundry basket and the agitator relative to one another, and a pump assembly pumps water from the tub to a drain to execute a wash cycle.

At least some known clothes treatment machines need an operator to input an amount of the laundry within the machine by manual selection from several predetermined levels, such as for example, SMALL, MEDIUM, and LARGE. However, such levels typically do not precisely indicate the actual amount of the laundry, such as the weight of the laundry. In addition, such selection needs to be performed at the beginning of every washing process, which is an additional step to be performed by the operator, and the laundry amount may be set to an incorrect initial level if the operator forgets to perform such selection.

BRIEF DESCRIPTION OF THE INVENTION

In one aspect, a control system for a home appliance is provided. The home appliance includes a cabinet, a wash tub positioned within the cabinet and configured to receive laundry therein, and a fill device configured to deliver liquid into the tub. The control system includes a first detecting component configured to detect an amount of the liquid delivered into the wash tub, a second detecting component configured to detect a liquid level in the wash tub, and a controller operatively coupled with the detecting components. The controller is configured to receive signals from the detecting components and calculate an amount of the laundry positioned within the wash tub based on the received signals.

In another aspect, a home appliance is provided. The appliance includes a cabinet, a wash tub positioned within the cabinet, the wash tub configured to receive laundry therein, and a fill device positioned within the cabinet, the fill device configured to deliver liquid into the wash tub. The appliance also includes a first detecting component configured to detect an amount of the liquid channeled through the fill device and delivered into the wash tub, a second detecting component configured to detect a liquid level in the wash tub, and a controller operatively coupled with the detecting components. The controller is configured to receive signals from the detecting components and estimate an amount of the laundry positioned within the wash tub based on the received signals.

In still another aspect, a method for assembling a home appliance is provided. The method includes providing a cabinet, positioning a wash tub within the cabinet, the wash tub configured to receive laundry therein, and positioning a fill device within the cabinet, the fill device configured to deliver liquid into the wash tub. The method also includes providing a first detecting component configured to detect an amount of the liquid delivered into the wash tub, providing a second detecting component configured to detect a liquid level in the wash tub, and operatively coupling a controller with the detecting components. The controller is configured to receive signals from the detecting components and calculate an amount of the laundry positioned within the wash tub based on the received signals.

In still another aspect, a predictive tool for a home appliance is provided. The appliance includes a cabinet, a wash tub positioned within the cabinet and configured to receive laundry therein, and a fill device configured to deliver liquid into the tub. The predictive tool includes a first monitoring component configured to be mounted within the cabinet and monitor an amount of the liquid delivered into the wash tub, a second monitoring component configured to be mounted within the cabinet and monitor a liquid level in the wash tub, and a microprocessor operatively coupled with the monitoring components. The microprocessor is configured to receive signals from the monitoring components and estimate a load of the laundry positioned within the wash tub based on the received signals.

DETAILED DESCRIPTION OF THE INVENTION

Figure 1:
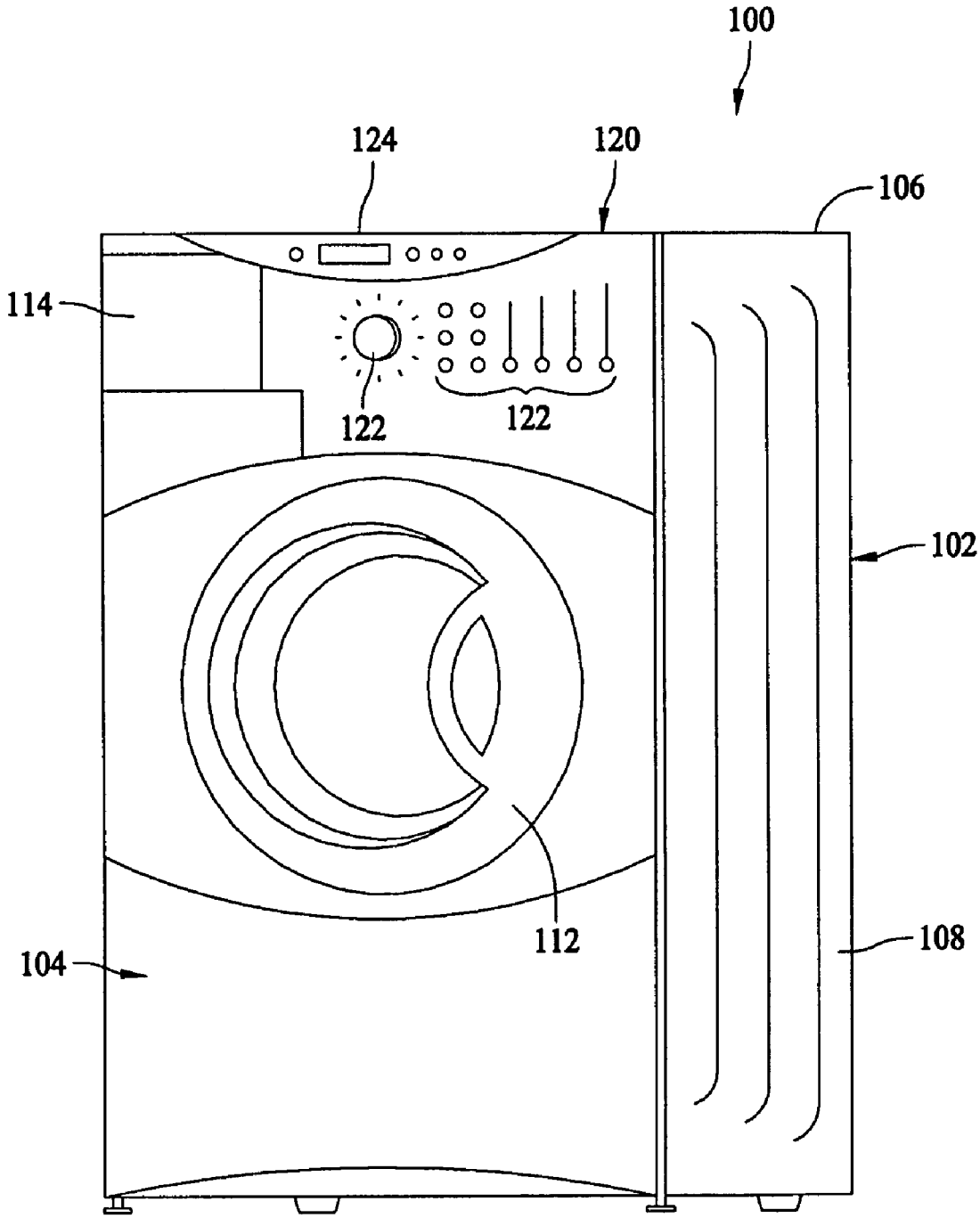
FIG. 1 is a perspective view of an exemplary washing/dry cleaning combination machine.

FIG. 1 is a perspective view of an exemplary washing/dry cleaning combination machine 100 applicable to the present invention. Washing/dry cleaning machine 100 may be selectively operated in a water washing process or a dry cleaning process to clean the laundry positioned therein. Washing/dry cleaning machine 100 includes a cabinet 102 having a front panel 104, a top panel 106, and side panels 108. A door 112 is mounted to front panel 104 and is rotatable about a hinge (not shown) between an open position (not shown) facilitating access to a basket (not shown) in the interior of washing/dry cleaning machine 100 that holds a clothes load, and a closed position (as shown in FIG. 1) forming a substantially sealed enclosure over the basket. Front panel 104 also includes a cover 114 that covers a dual lint filter user interface (shown in FIG. 2). A control panel 120 including a plurality of input selectors 122 is coupled to an upper portion of front panel 104. Control panel 120 and input selectors 122 collectively form a user interface for operator selection of machine cycles and features, and, in one embodiment, a display section 124 indicates selected features, machine status, and other items of interest to users.

As illustrated in FIG. 1, washing/dry cleaning machine 100 is a horizontal axis machine. It is contemplated that the present invention is applicable, not only to horizontal axis machines, such as washing/dry cleaning machine 100, but to other forms of clothes treatment machines as well, such as vertical axis machines. It is also contemplated that the benefits of the present invention accrue to other forms of clothes treatment machines, such as for example, washing machines, dry cleaning machines, and washer/dryer combination machines. Therefore, washing/dry cleaning machine 100 is provided by way of illustration rather than limitation. Accordingly, the following description is for illustrative purposes only, and there is no intention to limit application of the present invention to any clothes treatment machine, such as washing/dry cleaning machine 100.

Figure 2:
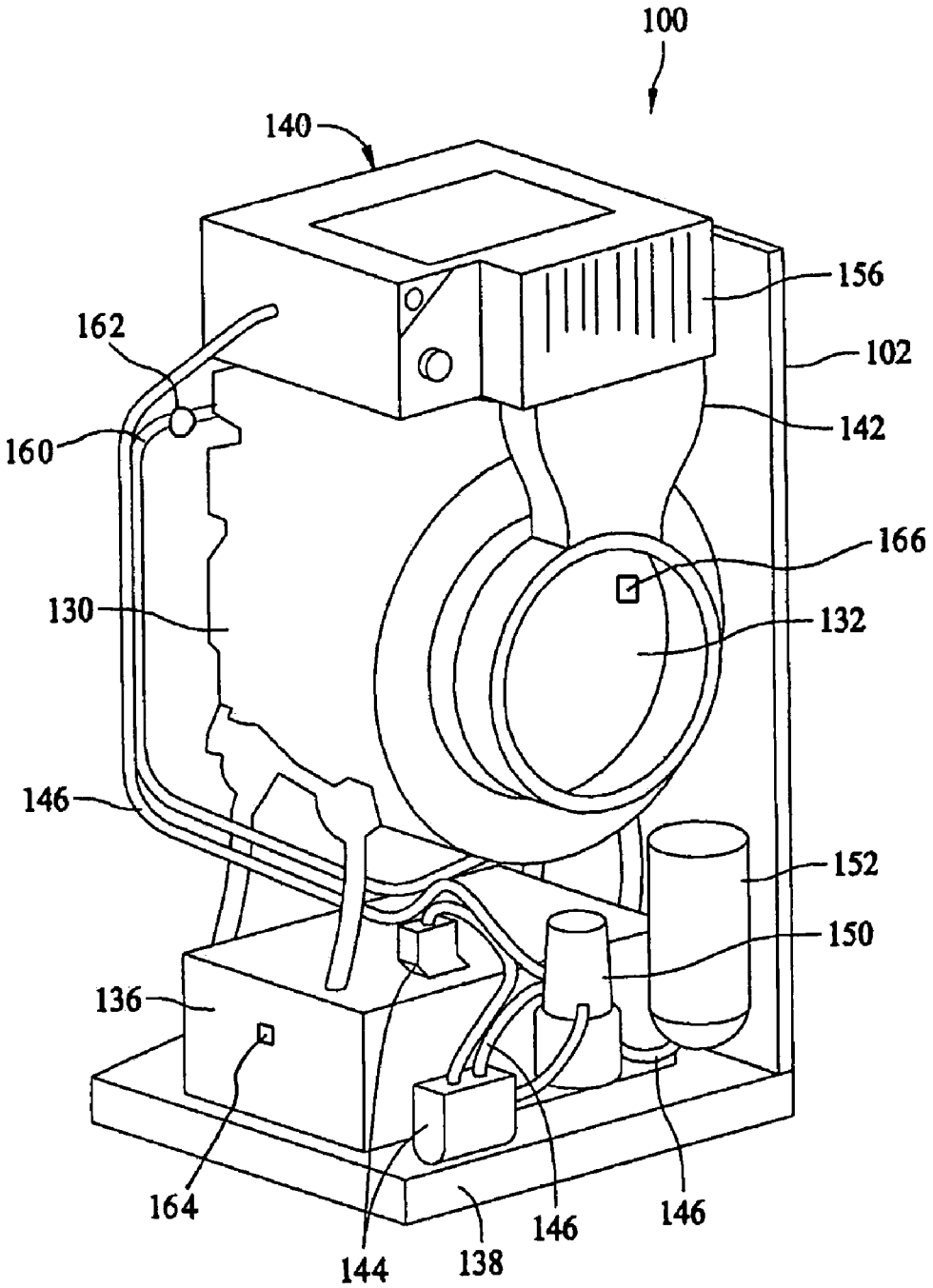
FIG. 2 is a perspective cutaway view of the washing/dry cleaning machine with a cabinet partially removed.

FIG. 2 is a perspective cutaway view of cleaning machine 100 with the cabinet 102 partially removed. Cleaning machine 100 includes a tub 130 that has an opening 132 which provides access to the clothes basket (not shown) that is rotatably mounted within tub 130. A storage tank 136 for dry cleaning fluid is located on a cabinet base platform 138 beneath tub 130. Dry cleaning fluid, due to its cost is recycled after clothes are cleaned and stored in storage tank 136 for reuse. A fluid recovery system 140 is positioned above tub 130 to recover liquid and evaporated dry cleaning fluid as will be described. A return duct 142 returns filtered air from fluid recovery system 140 to tub 130. A plurality of pumps 144 are located beneath tub 130 to deliver dry cleaning fluid from storage tank 136 to various components of cleaning machine 100, including tub 130 and to return recovered fluid to storage tank 136. A plurality of fluid lines 146 extend between pumps 144, storage tank 136, tub 130, fluid recovery system 140, as well as a water separator 150 and a canister filter 152, and other components.

Water separator 150 removes water from the dry cleaning fluid in the dry cleaning process. Water is not normally used in the dry cleaning process, however, water may be present in washing/dry cleaning machine 100 from humidity in the air or a wet garment in the clothes load. Canister filter 152 is part of a multi-stage filtration process, the first stage of which occurs in fluid recovery system 140.

Operation of cleaning machine 100 is controlled by a main controller, or microprocessor 156 which is operatively coupled to the user interface input located on front panel 104 (shown in FIG. 1) of cleaning machine 100 for user manipulation to select dry cleaning machine cycles and features. In response to user manipulation of the user interface input, main controller 156 operates the various components of cleaning machine 100 to execute selected machine cycles and features.

Washing/dry cleaning machine 100 also includes a fill device 160 coupled in flow communication with wash tub 130, a flow meter 162 coupled in flow communication with fill device 160, a tank level sensor 164 for detecting a liquid level within storage tank 136, and a tub level sensor 166 for detecting a liquid level within wash tub 130.

Fill device 160 is used to deliver liquid into wash tub 130. Specifically, in the water washing process, fill device 160 channels water from a water supply (not shown) located outside cleaning machine 100 into wash tub 130. In the dry cleaning process, fill device 160 cooperates with pump 144 to channel water from storage tank 136 into wash tub 130. In an alternative embodiment, fill device 160 includes two conduits (not shown) used to deliver water/dry cleaning liquid into wash tub 130 in the water washing/dry cleaning process, respectively.

Flow meter 162 meters the amount of liquid flowing therethrough to detect the liquid amount delivered into wash tub 130 in the water washing/dry cleaning process. In an alternative embodiment, a liquid delivering timer (not shown) may be employed to monitor a time period of fill device 160 delivering liquid into wash tub 130, and the amount of liquid delivered into wash tub 130 may be calculated based on the monitored time period. In still another alternative embodiment, tank level sensor 164 is employed to detect the amount of liquid delivered in the dry cleaning process. Tank level sensor 164 detects the liquid level within storage tank 136 before/after delivering dry cleaning liquid into wash tub 130. In one embodiment, a plurality of pressure switches (not shown) are employed in lieu of tank level sensor 130, and the pressure switches are mounted on storage tank 136 at different heights for respectively detecting whether the water level in storage tank 136 reaches a corresponding predetermined level in alternative embodiments.

Tub level sensor 166 is mounted on wash tub 130 for detecting a liquid level within wash tub 130 both in the water washing and the dry cleaning processes. In one embodiment, a plurality of pressure switches (not shown) are employed and mounted on wash tub 130 at different heights for respectively detecting whether the water level in wash tub 130 reaches a corresponding level in alternative embodiments.

Figure 3:
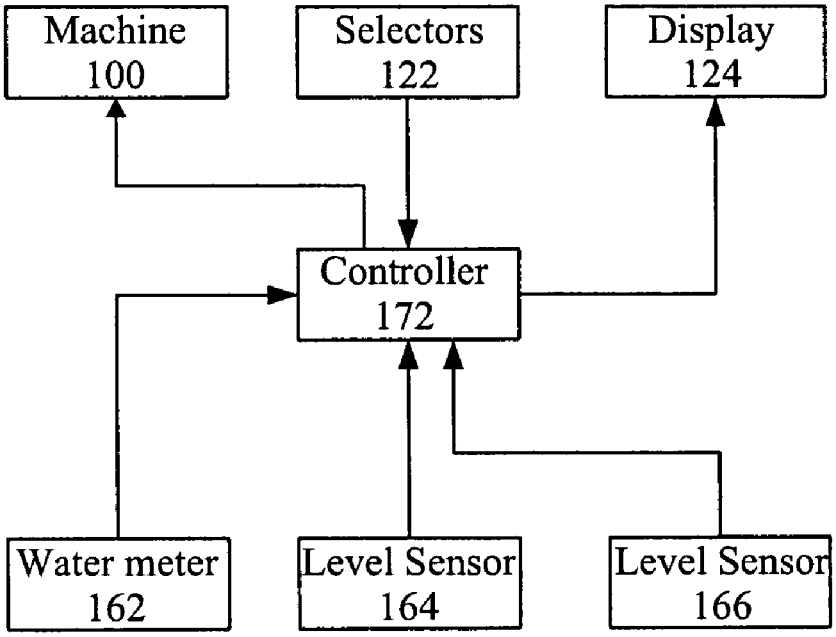
FIG. 3 is a schematic view of an exemplary control system applicable to the washing/dry cleaning machine shown in FIG. 1.

FIG. 3 is a schematic view of an exemplary control system 170 applicable to cleaning machine 100 shown in FIG. 1. Controller 156 is operatively coupled with tub level sensor 166, flow meter 162, and/or the liquid delivering timer (not shown) and tank level sensor 164, and receives signals therefrom. As such, controller 156 is able to estimate a laundry amount within machine 100 based on received signals (described in detail hereinafter). Controller 156 is also operatively coupled with the various components of machine 100, such as for example, a motor (not shown) for driving the clothes basket (not shown) to rotate, and fluid recovery system 140 for drying the laundry at the end of the dry cleaning process. Controller 156 may further control the operation of the machine components based on the estimated laundry amount (described in detail hereinafter).

Figure 4:
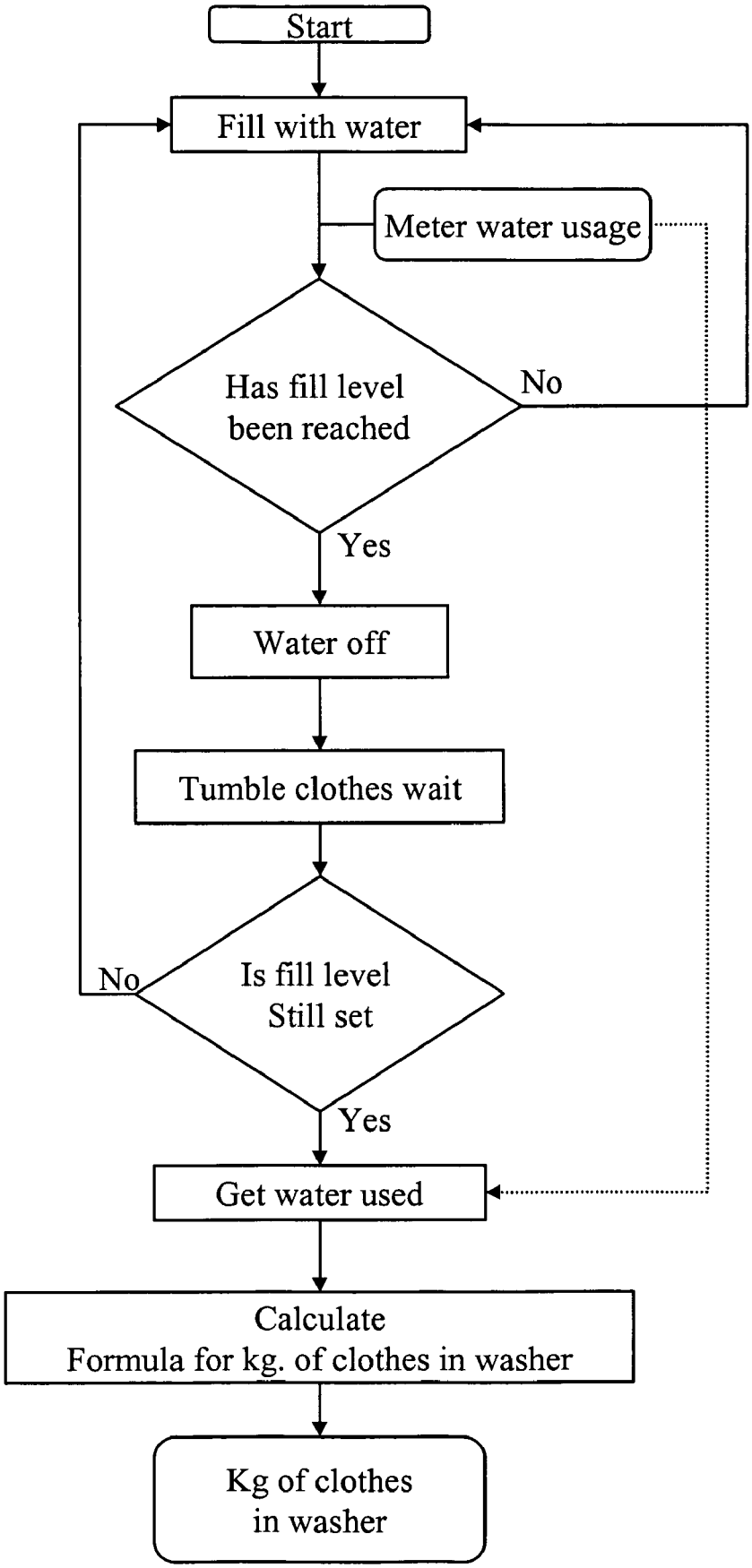
FIG. 4 is a flow chart of an exemplary laundry amount estimating method applicable to the washing/dry cleaning machine shown in FIG. 1.

FIG. 4 is a flow chart of an exemplary laundry amount estimating method 200 applicable to cleaning machine 100 shown in FIG. 1. It is contemplated, however, that the methodology described below could be implemented in various other software schemes familiar to and appreciated by those in the art, and method 200 may be utilized by other water treatment machines, such as for example, water washers, dry cleaning machines, and washer/dryer combination machines in alternative embodiments.

When the operator starts 202 the water washing/dry cleaning process, controller 156 (shown in FIG. 2) starts a liquid delivering process to operate fill device 160 (shown in FIG. 2) to deliver liquid, such as water or dry cleaning liquid, into wash tub 130 (shown in FIG. 2) therethrough. Flow meter 162 (shown in FIG. 2) meters 206 the amount of liquid channeling through fill device 160. In an alternative embodiment, the liquid delivering timer (not shown) is employed to calculate the total time of fill device 160 delivering liquid into wash tub 130. In still another alternative embodiment, tank level sensor 164 (shown in FIG. 2) is employed to detect the liquid level within storage tank 136.

Tub level sensor 166 (shown in FIG. 2) detects the liquid level in wash tub 130, and controller 156 stops 210 delivering liquid into wash tub 130 when the liquid level in wash tub 130 reaches 208 a predetermined level. Controller 156 then rotates the clothes basket (not shown) to submerse the laundry into the liquid and get a good absorption of the liquid. Controller 156 then determines whether the liquid level in wash tub 130 is still at the predetermined level.

If the liquid level in wash tub 130 is below the predetermined level, which may occur, for example, due to some of the liquid being absorbed by the laundry, controller 156 returns to above steps 204-210 to fill wash tub 130 to the predetermined level, and checks 214 the liquid level again after rotating 212 the clothes basket. Once the liquid level in wash tub 130 reaches the predetermined level, controller 156 calculates 216 an amount of the liquid delivered into wash tub 130 based on the signals received from flow meter 162, the liquid delivering timer, and/or tank level sensor 164.

In one embodiment, the delivered liquid amount is obtained 216 from the amount of the liquid flowing through flow meter 162. In an alternative embodiment, the delivered liquid amount is calculated based on the total liquid delivering time detected by the liquid delivering timer and the flow rate within fill device 160. In still another alternative embodiment, the delivered liquid amount is monitored based on the difference between the tank liquid levels detected by tank level sensor 164 before and after the liquid delivering process. As such, tank level sensor 164 monitors the amount of dry cleaning liquid channeled from storage tank 136 into wash tub 130 in the dry cleaning process.

After the delivered liquid amount is calculated 218, controller 156 calculates a volume difference based on the detected liquid amount delivered into wash tub 130 and the detected liquid level in wash tub 130, and estimates 218 an amount of the laundry positioned within wash tub 130 based on the calculated volume difference. Specifically, controller 156 calculates a weight of the laundry W by the equation:

$$W=A\times L-B$$

where A is a predetermined density of the laundry, L is the calculated volume difference, and B is a predetermined value. B is used to adjust the calculated weight, because some of the liquid is absorbed by the laundry and some residuals exist around the laundry in wash tub 130 which together affect the detected liquid level in wash tub 130. In an exemplary embodiment, W=0.178×L−0.596. It is contemplated, however, that A and B are experimentally decided based on various experiments of different cloths types, cloths weights and the amounts of fluid dispensed into wash tub 130. A and B may be altered depending on different machines or clothes types, and B may be positive, negative, or zero in alternative embodiments. As such, controller 156 estimates 220 a weight of the laundry within wash tub 130.

After the laundry amount is estimated 220, controller 156 controls the operation of the various components of machine 100 based on the calculated laundry amount. In an exemplary embodiment, controller 156 determines the amount of detergent to be used based on the estimated laundry amount in the water washing process. In another exemplary embodiment, controller 156 determines the amount of the dry cleaning fluid to be used based on the estimated laundry amount in the dry cleaning process. In still another exemplary embodiment, controller 156 energizes fluid recovery system 140 (shown in FIG. 2) for a determined time period based on the estimated laundry amount to dry the laundry at a drying portion of the dry cleaning process. In still another exemplary embodiment, controller 156 records the estimated laundry amount into an operation history, and decides when to prompt the operator to maintain machine 100 according to the operation history. Specifically, controller 156 decides when to replace/maintain filters, such as canister filter 152 (shown in FIG. 2) and prompts the operator according to the operation history.

Controller 156 automatically estimates the amount of the laundry positioned within wash tub 130, and further calculates the sum of the laundry amount in a predetermined time period. Thus, controller 156 accurately manages when the machine components reach their operational life and prompts the operator when to replace/maintain the machine components. In addition, in a further embodiment, controller 156 may automatically decides some factors in the water washing/dry cleaning process, and considerably reduces the operator's input in the process.

While the invention has been described in terms of various specific embodiments, those skilled in the art will recognize that the invention can be practiced with modification within the spirit and scope of the claims.

What is claimed is:

1. A control system for an appliance including a cabinet, a wash tub positioned within the cabinet and configured to receive laundry, and a fill device configured to deliver liquid into the wash tub, said control system comprising:

a first detecting component configured to detect an amount of the liquid delivered into the wash tub;

a second detecting component configured to detect a liquid level in the wash tub; and a controller operatively coupled with said first detecting component and said second detecting component, said controller configured to receive signals from said first detecting component and said second detecting component and calculate a volume difference based on the detected liquid amount delivered into the wash tub and the detected liquid level in the wash tub, said controller further configured to calculate a weight of the laundry (W) by the equation:

$$W=A\times L-B,$$

where A is a density of the laundry, L is the calculated volume difference, and B is a predetermined value based on liquid absorbed by the laundry and residual liquid around the laundry in the wash tub.

2. A control system in accordance with claim 1 wherein said first detecting component is configured to detect a liquid level in a storage tank of the home appliance.

3. A control system in accordance with claim 1 wherein said controller is configured to detect whether the liquid level reaches a predetermined level after rotating the laundry within the wash tub.

4. A control system in accordance with claim 3 wherein said controller is configured to detect the laundry amount when the liquid level reaches the predetermined level.

5. A control system in accordance with claim 1 wherein said controller configured to control the operation of the appliance based on the calculated laundry amount.

6. A control system in accordance with claim 1 wherein said controller is configured to:

store a plurality of calculated weights of laundry for a plurality of loads of laundry;

determine a total weight of the plurality loads of laundry using the plurality of calculated weights of laundry; and prompt a user to perform maintenance on the appliance based on the total weight.

7. A control system in accordance with claim 6 wherein said controller is configured to prompt the user to change a filter within the appliance.

8. A control system in accordance with claim 1 wherein said first detecting component comprises a liquid delivering timer for detecting the amount of the liquid delivered into the wash tub.

9. A control system in accordance with claim 1 wherein said first detecting component comprises a flow meter for detecting the amount of the liquid delivered into the wash tub.

10. A control system in accordance with claim 1 wherein said controller is configured to control an amount of detergent added to the wash tub based on the calculated weight of the laundry.

11. A control system in accordance with claim 1 wherein said controller is configured to activate a fluid recovery system of the appliance for a duration of time based on the calculated weight of the laundry.

12. An appliance comprising:

a cabinet;

a wash tub positioned within said cabinet, said wash tub configured to receive laundry;

a fill device positioned within said cabinet, said fill device configured to deliver liquid into said wash tub;

a first detecting component configured to detect an amount of the liquid channeled through said fill device and delivered into said wash tub;

a second detecting component configured to detect a liquid level in said wash tub; and a controller operatively coupled with said first detecting component and said second detecting component, said controller configured to receive signals from said first detecting component and said second detecting component and calculate a volume difference based on the detected liquid amount delivered into the wash tub and the detected liquid level in the wash tub, said controller further configured to calculate a weight of the laundry (W) by the equation:

$$W=A\times L-B,$$

where A is a density of the laundry, L is the calculated volume difference, and B is a predetermined value based on liquid absorbed by the laundry and residual liquid around the laundry in the wash tub.

13. An appliance in accordance with claim 12 further comprising a storage tank configured to store dry cleaning liquid therein, said first detecting component configured to detect a liquid level in said storage tank.

14. An appliance in accordance with claim 12 wherein said controller is configured to detect whether the liquid level reaches a predetermined level after rotating the laundry within said wash tub.

15. An appliance in accordance with claim 14 wherein said controller is configured to detect the laundry amount when the liquid level reaches the predetermined level.

16. An appliance in accordance with claim 12 wherein said controller is configured to control the operation of said home appliance based on the estimated laundry amount.

17. A method for assembling an appliance comprising:

providing a cabinet;

positioning a wash tub within the cabinet, the wash tub configured to receive laundry;

positioning a fill device within the cabinet, the fill device configured to deliver liquid into the wash tub;

providing a first detecting component configured to detect an amount of the liquid delivered into the wash tub;

providing a second detecting component configured to detect a liquid level in the wash tub; and operatively coupling a controller with the first detecting component and the second detecting component, the controller configured to receive signals from the first detecting component and the second detecting component and calculate a volume difference based on the detected liquid amount delivered into the wash tub and the detected liquid level in the wash tub, the controller further configured to calculate a weight of the laundry (W) by the equation:

$$W=A\times L\times B,$$

where A is a density of the laundry, L is the calculated volume difference, and B is a predetermined value based on liquid absorbed by the laundry and residual liquid around the laundry in the wash tub.

18. A method in accordance with claim 17 further comprising positioning a storage tank within the cabinet and in flow communication with said wash tub, the storage tank configured to store dry cleaning liquid therein, said providing a first detecting component comprising providing a first detecting component configured to detect a liquid level in the storage tank.

19. A method in accordance with claim 17 wherein said coupling a controller comprises coupling a controller configured to detect whether the liquid level reaches a predetermined level after rotating the laundry within the wash tub.

20. A method in accordance with claim 19 wherein said coupling a controller comprises coupling a controller configured to detect the laundry amount when the liquid level reaches the predetermined level.

21. A predictive tool for an appliance including a cabinet, a wash tub positioned within the cabinet and configured to receive laundry, and a fill device configured to deliver liquid into the tub, said predictive tool comprising:

a first monitoring component configured to be mounted within the cabinet and monitor an amount of the liquid delivered into the wash tub;

a second monitoring component configured to be mounted within the cabinet and monitor a liquid level in the wash tub; and a microprocessor operatively coupled with said first monitoring component and said second monitoring component, said microprocessor configured to receive signals from said first monitoring component and said second monitoring component and calculate a volume difference based on the detected liquid amount delivered into the wash tub and the detected liquid level in the wash tub, said microprocessor configured to calculate a weight of the laundry (W) by the equation:

$$W=A\times L-B,$$

where A is a density of the laundry, L is the calculated volume difference, and B is a predetermined value based on liquid absorbed by the laundry and residual liquid around the laundry in the wash tub.

22. A predictive tool in accordance with claim 21 wherein said microprocessor is configured to detect whether the liquid level reaches a predetermined level after rotating the laundry within the wash tub.

* * * * *